US009908151B2

(12) United States Patent
Dopfer et al.

(10) Patent No.: US 9,908,151 B2
(45) Date of Patent: Mar. 6, 2018

(54) APPARATUS FOR PROCESSING VALUE DOCUMENTS

(75) Inventors: Peter Dopfer, Geltendorf (DE); Wolfgang Koniger, Karlsfeld (DE); Mario Monch, Unterhaching (DE); Marcel Zandl, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 393 days.

(21) Appl. No.: 14/237,073

(22) PCT Filed: Aug. 6, 2012

(86) PCT No.: PCT/EP2012/003356
§ 371 (c)(1),
(2), (4) Date: Feb. 4, 2014

(87) PCT Pub. No.: WO2013/020697
PCT Pub. Date: Feb. 14, 2013

(65) Prior Publication Data

US 2014/0202936 A1 Jul. 24, 2014

(30) Foreign Application Priority Data

Aug. 8, 2011 (DE) ..... 10 2011 109 798

(51) Int. Cl.
*G07F 7/04* (2006.01)
*B07C 5/00* (2006.01)
*G07D 11/00* (2006.01)

(52) U.S. Cl.
CPC ..... *B07C 5/00* (2013.01); *G07D 11/0003* (2013.01); *G07D 11/0036* (2013.01);
(Continued)

(58) Field of Classification Search
CPC ..... G07D 11/00; G07D 11/0003; G07D 11/0021; G07D 11/0024; G07D 11/0027;
(Continued)

(56) References Cited

U.S. PATENT DOCUMENTS 2,981,421 A * 4/1961 Fettig et al. ..... 271/305
3,310,794 A * 3/1967 Lusebrink ..... 340/594
(Continued)

FOREIGN PATENT DOCUMENTS

DE 8525658 U1 11/1985
DE 42 40 751 A1 6/1994
(Continued)

OTHER PUBLICATIONS

German Search Report from DE Application No. 10 2011 109 798.1, dated Mar. 19, 2012.
(Continued)

*Primary Examiner* — Jeffrey A Shapiro
(74) *Attorney, Agent, or Firm* — Justin Cassell; Workman Nydegger

(57) ABSTRACT

An apparatus for processing value documents, in particular banknotes, comprises more processing zones respectively having at least one cover for covering an internal space of the processing zone in question. An interior lighting means is provided and at least one region of the cover or adjacent to the cover is semitransparent. The internal space can thus be viewed through the semitransparent region only when the interior lighting means is switched on. Upon detecting an error in the bank note processing, the interior lighting means of the processing zone in question lights up automatically, thus guiding the operator directly to the location of the problem.

17 Claims, 1 Drawing Sheet

(52) U.S. Cl.
CPC ..... *G07D 11/0081* (2013.01); *G07D 11/0039* (2013.01); *G07D 11/0042* (2013.01); *G07D 11/0045* (2013.01); *G07D 11/0048* (2013.01); *G07D 11/0063* (2013.01)

(58) Field of Classification Search
CPC ..... G07D 11/003; G07D 11/0033; G07D 11/0036; G07D 11/0039; G07D 11/0042; G07D 11/0045; G07D 11/0048; G07D 11/0051; G07D 11/0054; G07D 11/0063; G07D 11/0066; G07D 11/0084; G07D 11/0087; G07D 13/00; G07D 13/2205; G07D 2207/00; G07D 2211/00; G07F 7/00; G07F 7/005; G07F 19/00; G07F 19/20; G07F 19/201; G07F 19/202; G07F 19/203; G07F 19/209
USPC ..... 194/209, 206, 207; 209/534; 235/379; 902/8–17
See application file for complete search history.

(56) References Cited

U.S. PATENT DOCUMENTS

| | | | | |
|---|---|---|---|---|
| 5,592,189 | A | 1/1997 | Kuzunuki et al. | |
| 6,887,577 | B1 | 5/2005 | Keller et al. | |
| 7,954,700 | B2 | 6/2011 | Stapfer | |
| 8,403,206 | B2 | 3/2013 | Stapfer | |
| 2003/0136630 | A1* | 7/2003 | Miyashita | 194/302 |
| 2008/0186696 | A1* | 8/2008 | Awai et al. | 362/92 |
| 2008/0264962 | A1* | 10/2008 | Schifman et al. | 221/1 |
| 2009/0279771 | A1 | 11/2009 | Stapfer | |
| 2009/0293424 | A1* | 12/2009 | Mori | 53/167 |
| 2010/0246928 | A1* | 9/2010 | Takahama | G07D 7/00 382/140 |
| 2011/0120015 | A1 | 5/2011 | Schmidt et al. | |
| 2011/0134627 | A1* | 6/2011 | Hamlin et al. | 362/92 |
| 2011/0203900 | A1 | 8/2011 | Stapfer | |
| 2012/0247917 | A1* | 10/2012 | Frankenberger | G07D 7/121 194/207 |
| 2013/0278989 | A1* | 10/2013 | Lam et al. | 359/275 |

FOREIGN PATENT DOCUMENTS

| | | | |
|---|---|---|---|
| DE | 19938159 | A1 | 2/2001 |
| DE | 103 37 701 | A1 | 3/2005 |
| DE | 20 2005 004 210 | U1 | 5/2005 |
| DE | 10 2004 049 604 | A1 | 6/2005 |
| DE | 10 2006 028 632 | A1 | 12/2007 |
| DE | 10 2008 036 597 | A1 | 2/2010 |
| DE | 102009035938 | A1 | 2/2011 |
| WO | 2010015395 | A2 | 2/2010 |

OTHER PUBLICATIONS

International Search Report for corresponding International PCT Application No. PCT/EP2012/003356, dated Nov. 14, 2012.

* cited by examiner

APPARATUS FOR PROCESSING VALUE DOCUMENTS

BACKGROUND

The present invention relates to an apparatus for processing value documents, in particular a banknote processing machine or a module of such a machine.

SUMMARY

Such apparatus usually consist of several modules having one or several processing zones that are arranged in succession and execute different working steps. The number, type and arrangement of the modules can vary in dependence on the requirements for the processing of the value documents. A banknote processing machine typically comprises at least one input module, an operating module, as well as one or several output modules. Between the input zone of the input module and the output zone of the output module there are one or several check zones for automatically checking the value documents. The check zones in turn can be configured as a separate module. After inputting, the banknotes in the input module are initially singled and captured by sensors on a measuring path, said sensors for example serving to recognize banknotes that are unfit for circulation. These are separated from the banknotes fit for circulation and output separately or, if applicable, destroyed. The banknotes fit for circulation are transported further and are for example output in bundled form in the output module. Such an apparatus can have a shredder module for destroying selected banknotes and/or modules for stacking or bundling processed banknotes. The course of the banknote processing can be controlled and monitored by the operator via an operator interface that is usually disposed in the operating module. The modules can be interconnected partly by coupling modules and/or drive modules, which, if applicable, realize merely a transport zone for transporting the banknotes from one module to another module.

Such an apparatus is described for example in WO 2010/015395 A2. It is suggested there to support an operator upon the occurrence of an event that requires the operator's intervention in the working process. This can be the case for example when a banknote jam occurs or consumable material needs to be renewed. Particularly in the case of banknote processing machines having many different modules, exact information about the location of the necessary intervention is required, so that the operator can intervene in the right location and opens the right module. Accordingly, it is suggested in WO 2010/015395 to automatically open a cover associated with the detected event, e.g. a lift gate or flap, of the processing zone in question whenever an event is detected that requires manual intervention by the operator. Thereby the operator is guided directly to the processing zone in which the intervention is required.

However this solution may be undesirable for safety reasons, in case persons are in the vicinity of the banknote processing machine who could be caught unaware by the unexpected opening of the cover. In WO 2010/015395 A1 it is consequently further suggested to indicate the automatic opening of the cover by additional signals which can be acoustic and/or visually visible signals on the display of the operating module and/or on the module of the cover to be opened and/or on the cover itself, and which are started shortly before or simultaneously with the automatic opening of the cover. Alternatively, it is suggested to permit the automatic opening only after an opening confirmation by the operator, for example by displaying a message on the display of the operating module informing the operator that one of the covers will be automatically opened, while simultaneously informing about which of the covers will be automatically opened, so that the location of the intervention is indicated to the operator already at an early time. Thereby the safety of the staff is increased, but the decisive advantage of guiding the operator directly to the processing zone is lost partly at least.

It is the object of the present invention to improve an apparatus for processing value documents with regard to inspection friendliness and inspection safety.

This object is achieved according to the invention by an apparatus having the features of claim 1. In claims dependent thereon advantageous developments and embodiments of the invention are specified.

The apparatus has one or several processing zones and at least one cover for covering an internal space of the apparatus in the region of the one or several processing zones. Further, the apparatus has at least one interior lighting means, preferably respectively at least one interior lighting means of their own for individual or all processing zones. According to the invention, in at least one cover of the apparatus a region of the cover or adjacent to the cover is configured to be semitransparent. This means that the transparency of this region is limited at least for visible light. In particular, the internal space of the apparatus is shaded from impinging light thereby. The internal space of the processing zone in question covered by the cover is not or hardly observable through the semitransparent region when the interior lighting means is switched off. Only when the interior lighting means is switched on does the internal space of the apparatus in the processing zone in question become visible from the outside through the semitransparent region. In particular the transmittance of the semitransparent region for the light of the spectral range of the interior lighting means amounts to at least 20%, preferably at least 40%. In contrast, when the interior lighting means is switched off, at most a very small amount of light can pass from the internal space of the apparatus to the outside. For light, which possibly passes from the external space of the apparatus to the internal space and back, must pass the semitransparent region both upon transmission to the internal space and upon transmission from the internal space back to the external space, thus twice, and is strongly weakened in the process.

The light of the interior lighting means preferably comprises a spectral portion of the visible spectral range, e.g. a certain color, or the complete visible spectral range. In particular, in the visible spectral range at least 20%, preferably at least 40%, of the light are transmitted from the internal space of the apparatus through the semitransparent region. To achieve the desired weakening of the light impinging from the outside, the transmittance of the semitransparent region for the light of the visible spectral range in particular amounts to 80% at most, preferably 60% at most.

This technical solution makes it possible, in the case that an event is detected that requires the intervention of an operator, to first switch on only the interior lighting means of the processing zone associated with this event. Thereby the operator is guided directly to the location of the necessary intervention and can at once carry out a first visual inspection through the semitransparent region without having to open the cover for this purpose. Depending on the finding, the operator can then decide whether and when the cover must be opened to carry out an intervention in the apparatus. For this purpose preferably mechanical or electronic or other switches or devices for opening and, if applicable, also for subsequently closing the cover are provided in the vicinity of each cover. The cover can for example form a lift gate for flap of the apparatus.

However, the solution according to the invention also offers further advantages. Thus the operator can carry out an inspection of the processing zones also during the operation of the apparatus, by switching on the interior lighting means at any given time. Since the cover remains closed there is no safety risk for the operator. Preferably, a separate light switch is provided on each module. Provided that in a module different processing zones and/or several semitransparent regions are present in the cover or in the vicinity of the cover, a separate light switch can be provided for each processing zone or each transparent region. The correct functioning of the individual components of the transport system can thus be checked also during the operation of the machine, e.g. for inspecting the singling of the value documents, the transporting of the value documents along the transport path, as well as diversions or gates in the transport of the value documents and the stacking of the value documents.

In particular, the semitransparent cover makes a quasi-statistical check of the sheet material transport possible with the aid of suitably clocked illumination. From a clock generator of the apparatus generating a clock that is correlated with the rate of singling of sheet material or with the transport of the sheet material, an illumination clock is derived for the lighting means which illuminates one or several of the components of the apparatus completely or partly in accordance with the illumination clock. Based on the signals of the clock generator, a control device of the apparatus then switches the lighting on and off again periodically, corresponding to the rate and synchronous to the singling or to the transport of the banknotes. For the operator the banknote then seems to stand still. Actually, the operator does not see one single banknote, however, but different banknotes which are illuminated respectively corresponding to the illumination clock and can thus be seen seemingly statically. Through the thus clocked illumination the banknote and possible transport errors of the banknote can become visible in greater exactness.

In a high-speed processing machine for value documents the sound emission can be considerable. To keep the sound emission of the apparatus to a minimum, but to be able to nevertheless execute the semitransparent region over a large surface, the semitransparent region is consequently executed to be as soundproof as possible. In particular, said region does not consist of a single tinted glass plate, but the semitransparent region preferably has two plates arranged one behind the other, in particular glass plates, with different sound transmission behavior. The sound reduction index of the two plates is maximal for different frequencies, so that the one plate optimally dampens a certain sound frequency, while the other plate optimally dampens a different sound frequency. Depending on the machine elements operated in the processing zone in question, the plates are correspondingly selected on the basis of their specific sound transmission behavior. It is also possible to arrange more than two plates one behind the other which have different sound transmission behavior.

The different sound transmission behavior can be achieved in a simple fashion by the plates that are arranged one behind the other in the semitransparent region differing from each other with regard to their material thickness. Preferably, the thicknesses of the two plates differ from each other by at least 3 mm. Alternatively or additionally the plates can differ from each other also with regard to the type of plate material.

For further sound insulation it is advantageous when a sound dampening intermediate layer is provided between the plates arranged one behind the other. This can be an air layer or a different gas layer. The sound dampening layer can have a highly viscous gas, such as for example argon or krypton or consist of a vacuum that is as complete as possible. Preferably, the sound insulating intermediate layer is formed by a plastic layer disposed between the plates arranged one behind the other. The plastic can be chosen in accordance with its sound reduction index. The thicker the plastic layer is, the stronger is the sound dampening effect. Relatively soft and tough plastics usually have higher sound reduction indices than other plastics. Therefore, a plastic layer of polyvinyl butyral (PVB) or also of thermoplastic polyurethanes (TPUs) or ethylene-vinyl acetate (EVA) is particularly suitable as intermediate layer.

It is particularly suitable when the plastic layer is adhesively bonded with the two plates, in particular since for the manufacture of the semitransparent regions the established laminated safety glass technology can be made use of. The laminated plate can then be adhesively bonded on its edges with the cover or the machine frame.

The semitransparency of the see-through region in the cover can be achieved in different ways. Thus for example the plastic layer arranged between two plates can be configured as a neutral density filter by dyeing it correspondingly. Alternatively or additionally one or several of the plates can be tinted. For example gray-tinted glass can be used. Alternatively or additionally one or several mirror coating layers can be applied to a plate, for example on the outer glass plate of a laminated plate. The mirror coating layer can be employed to achieve the desired weakening of the light impinging from the outside. The mirror coating layer can in particular by a thin, vapor-deposited metal layer, for example of aluminum. When an internal space of the apparatus is dark, the layer acts like a mirror for the viewer as long as the interior lighting means is not switched on.

In total, it is advantageous for the semitransparent effect of the see-through region when the apparatus has no further transparent or semitransparent region in the region of the respective processing zone in question, through which further region light could pass into the internal space of the apparatus.

The apparatus according to the invention makes it possible, after an automatic stop of the banknote transport, for example in the case of a banknote jam, to check from the outside by switching on the interior lighting means whether and where there are still banknotes disposed in the transport path.

The correct functioning of the individual components of the transport system, such as for example the banknote singling, the transporting of the banknotes along the transport path, possible diversions or gates and the stacking of the banknotes, can be checked from the outside through the semitransparent region also during the operation of the machine. Moreover, the invention makes it possible that also a single operator can check the transport path by viewing from the outside, since the four-eyes principle, i.e. the presence of a second operator, is frequently required for opening the machine cover for safety reasons. For checking the transport path a time advantage arises furthermore, since the opening and closing of the cover can be omitted, provided that no intervention by the operator is required. And finally, the noise emission of the machine is reduced, since it does not necessarily have to be opened for checking, and furthermore noise protection results from the employment of a special sound dampening see-through region.

To the extent that reference was made above to the processing of banknotes, this is applicable to the same degree to processing different kinds of value documents, in particular sheet-type value documents, such as checks, tickets, vouchers and the like.

BRIEF DESCRIPTION OF THE DRAWINGS

Hereinafter the invention will be explained by way of example with reference to the accompanying drawings. The figures are described as follows.

DETAILED DESCRIPTION OF VARIOUS EMBODIMENTS

Figure 1:
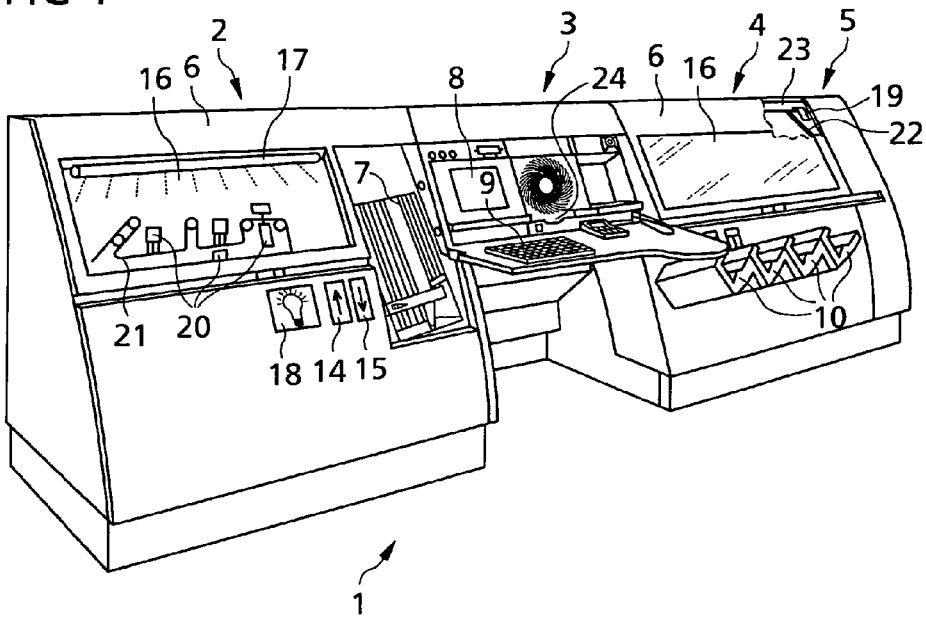
FIG. 1 a general view of a banknote processing machine in a perspective view, FIG. 2 a general view of a banknote processing machine with further modules in a frontal view.

In FIG. 1 a banknote processing machine 1 is represented which is built up of many different processing zones realized by modules 2, 3, 4, 5. The banknote processing machine 1 consists of an input module 2, an operating module 3, an output module 4 and optionally a shredder module 5. Banknotes which are to be processed by the banknote processing machine 1 are inserted by an operator in the input module 2 arranged on the left next to the operating module 3. For this purpose the input module 2 comprises an input pocket 7 which receives a stack of banknotes. After inputting, the banknotes are singled by means of a singler and are checked by a measuring system in the form of a measuring path with check sensors 20 and interjacent transport paths 21, for example for authenticity and/or their denomination and/or for their state, in particular their fitness for circulation. The input module 2 is followed by the operating module 3 which has an operating interface with screen 8 and an input device 9 for operating the banknote processing machine 1 by an operator. Further, in the operating module 3 a return pocket 24 is accommodated, in which banknotes are stacked that were rejected due to the measurements in the input module 2, for example banknotes which were recognized as forged or banknotes which could not be identified uniquely by the check sensors 20 in the input module 2. The banknotes from the return pocket 24 are subsequently checked manually and, if applicable, input in the input module 2 again. The other banknotes are transported along a transport path in the banknote processing machine 1 to the output module 4.

The output of the checked banknotes in the output module 4 takes place in bundled or stacked form. For this purpose the output module 4 has several stackers, strappers, as well as banknote output pockets 10. Depending on the volume to be processed, a banknote processing machine 1 can have several output modules 4, to be able to process larger amounts of banknotes as well and output them together.

In the downstream shredder module 5 banknotes which were recognized as unfit for circulation, i.e. for example damaged or strongly soiled banknotes, can be destroyed and subsequently output in a secured pocket for disposal. The banknote processing machine 1 further can also contain a revision stacker for stacking banknotes which are unfit for circulation and which are not to be destroyed. Optionally, also a bundler can be connected to the banknote processing machine 1, in which the banknotes are bundled into units of a predetermined piece number and wrapped in plastic foil.

Figure 2:
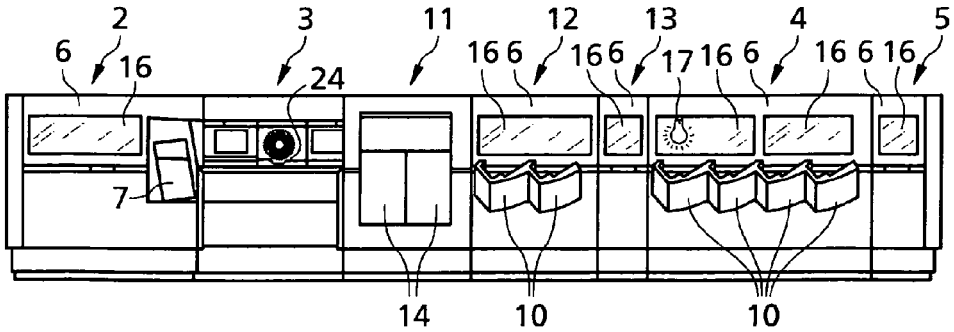

In FIG. 2 the structure of a banknote processing machine is shown which has additional modules besides the input module 2, the operating module 3, the output module 4 and the shredder module 5. Thus two additional output modules 11, 12 raise the output volume of the banknote processing machine. The large output module 11 has two output stackers 14 without strapper for outputting, in which larger amounts of banknotes can be output in a loosely stacked state. Additionally, this complex banknote processing machine comprises also a coupling module 13 connecting the output modules 12 and 4 with each other. This coupling module 13 can be configured as a pure drive module to optimize the transport of the banknotes to be processed along the long transport path.

The modules of the banknote processing machine 1, in particular the input module 2, the shredder module 5, the coupling module 13 and the output modules 4, 11 and 12 are closed by covers 6 which are configured as lift gates here. For this purpose the covers 6 are fixed via a suspension 19 to a fixed part of the machine frame 23, as represented exemplarily in FIG. 1. The lifting of the lift gate takes place by means of a gas-filled spring 22. The construction of the movement mechanism for opening and closing the covers 6 is described in detail in WO 2010/015395 A1, and reference is made to the description there to this extent.

The covers 6 respectively have semitransparent see-through regions 16 and an interior lighting means 17 arranged on the inside of the respective module. The semitransparency of the semitransparent region 16 is chosen in such a fashion that when the interior lighting means 17 is not switched on, it is impossible to see into the internal space through the semitransparent region. The machine elements disposed behind the cover 6 remain invisible to the viewer. Only by switching on the interior lighting means 17 do the machine elements become visible to the viewer. As semitransparent material the materials described at the outset come into question, with mirror-coated gray-tinted glass being particularly preferred.

The input module 2 has two processing zones, on the one hand the input zone with the input pocket 7 and a banknote singler which is not represented in detail here, and on the other hand a check zone with sensors 20 for checking authenticity, denomination and fitness for circulation. The check zone could in fact also be subdivided into three check zones, but is treated here as one processing zone. Accordingly, only one interior lighting means 17 is provided in the form of a fluorescent tube by which the complete processing zone can be illuminated for inspection purposes. It is switched on in FIG. 1, so that the check zone in the internal space of the input module 2 becomes visible. In the output module 4 no interior lighting means is switched on, so that the semitransparent region 16 has a mirror effect and is accordingly opaque.

In FIG. 2 a different processing zone is illuminated in contrast. As explained above, the output module 4 has several banknote output pockets 10, namely four output pockets, and a corresponding number of (not represented) stackers and strappers. In the embodiment according to FIG. 2 each banknote pocket 10 with associated stacker and strapper is treated as a processing zone of its own, and with each processing zone a respective interior lighting means 17 is associated. In the embodiment represented in FIG. 2 merely the interior lighting means 17 of the processing zone of the output module 4 associated with the left output pocket 10 is switched on, so that exactly this processing zone can be inspected well, whereas the other semitransparent regions 16 remain opaque.

This variant is optimally suitable for a special functionality of the banknote processing apparatus. According to this functionality, special events that require an intervention by the operator, such as for example a banknote jam, are detected by means of suitable sensors. In the case that such an event is detected, the interior lighting means 17 at least of the processing zone concerned by this event is automatically switched on. In FIG. 2 this is represented for the processing zone associated with the left banknote output pocket 10 of the output module 4.

The operator is guided by the interior lighting means 17 directly to the processing zone in which the event was detected. The machine does not necessarily have to be stopped, for the cover 6 is still closed. Thus there is no safety risk for the operator. Through the semitransparent plate 16, the operator can inspect the machine elements disposed behind said plate, and can open the cover 6 if required, to gain access to the machine elements. For this purpose a switch 16 is provided in the vicinity of each cover 6. The cover 6 opens as soon as the switch 14 is actuated. The cover 6 can be closed again with the switch 15 (or, if applicable, by actuating the switch 14 again). The restart of the machine takes place subsequently from the operating panel 3.

Additionally, a light switch 18 is provided in the vicinity of each cover 6, to make possible an inspection of the machine elements through the semitransparent region 16 at any time, when no such special event was detected by the machine. The switches 14, 15, 18 are integrated in the lower housing part of the respective processing zone that does not belong to the cover 6 and remains stationary upon opening the cover 6. The switches 14, 15, 18 can e.g. be configured as touch screen operating elements.

The semitransparent area 16 does not necessarily have to form part of the movable cover 6, but can be configured alternatively or additionally adjacent to the movable cover, in particular as a stationary component of a housing wall of the apparatus.

To achieve good sound insulation, the semitransparent region is preferably formed by a sound dampening multilayered material. It is particularly preferred to employ (glass) plates of varying thickness, which, particularly preferably, as laminated (glass) plates with interjacent dampening layer consist of a specially sound insulating plastic, such as in particular PVB. Since the curve of the sound reduction index (e.g. in dB) as a function of the sound frequency differs in dependence on the respective glass plate thickness, a particularly high sound dampening over a large frequency range is achieved by a laminated glass plate that consists of a combination of several glass plates of varying thickness. For example for this purpose a plate of a thickness of 2 to 5 mm and a plate of a thickness of 6 to 9 mm are adhesively bonded to a composite. The total composite thickness of the laminated plate amounts to e.g. 8 to 14 mm. The foil disposed between the glass plates can be completely clear, i.e. not dyed, if the semitransparency is achieved in a different fashion, for example by employing mirror-coated gray-tinted glass plates.

The invention claimed is:

1. An apparatus for processing value documents, the apparatus comprising:

one or more processing zones; and at least one cover for covering an internal space of the apparatus in the region of the one or more processing zones;

wherein at least one illumination means is provided and at least one region of the cover or adjacent to the cover is semitransparent in such a fashion that the internal space of the apparatus in the region of the processing zone in question is visible through the semitransparent region when the illumination means is switched on, and wherein the apparatus further includes an illumination clock configured to generate a clocked signal that switches on and off the illumination means at a periodicity that corresponds to a transportation rate or a singling rate of the value documents within at least one of the processing zones.

2. The apparatus according to claim 1, wherein the internal space in the region of the processing zone in question is substantially invisible when the interior illumination means is switched off.

3. The apparatus according to claim 1, wherein the semitransparent region of the cover is configured to be semitransparent in such a fashion that the transmittance of the semitransparent region for the light of the spectral range of the interior illumination means amounts to at least 20%.

4. The apparatus according to claim 1, wherein the semitransparent region of the cover is configured to be semitransparent in such a fashion that the transmittance of the semitransparent region for the light of the visible spectral range amounts to at least 20%.

5. The apparatus according to claim 1, wherein the semitransparent region comprises a mirror coated layer on its side facing away from the internal space of the apparatus.

6. The apparatus according to claim 1, wherein the semitransparent region has at least two plates with different sound transmission behavior that are arranged one behind the other.

7. The apparatus according to claim 6, wherein the plates differ from each other with regard to their material thickness by at least 3 mm.

8. The apparatus according to claim 1, wherein the semitransparent region has at least two plates arranged one behind the other with at least one interjacent plastic layer, wherein the interjacent plastic layer has in particular polyvinyl butyral.

9. The apparatus according to claim 8, wherein the two plates are adhesively bonded with the plastic layer.

10. The apparatus according claim 8, wherein the plastic layer is configured as a neutral density filter and/or that at least one of the plates is tinted.

11. The apparatus according to claim 1, wherein the processing zone in question that is visible through the semitransparent region when the illumination means is switched on includes only one transparent or semitransparent region.

12. The apparatus according to claim 1, wherein the semitransparent region forms part of a lift gate or flap of the apparatus.

13. The apparatus according to claim 1, wherein at least one respective interior illumination means is associated with individual or all processing zones.

14. The apparatus according to claim 13, wherein the apparatus is adapted to detect events which require an intervention by an operator of the apparatus, wherein the apparatus is further adapted, upon detecting any of the events, to switch on the interior illumination means of at least one processing zone associated with the event.

15. The apparatus according to claim 1, wherein the apparatus is a banknote processing machine or a module of a banknote processing machine, comprising one or more of the following zones for processing banknotes:

at least one input zone, at least one transport zone, at least one check zone comprising sensors for automatically checking the banknotes for at least one or more of the following properties: authenticity, denomination, state;

at least one output zone, at least one shredder zone.

16. An apparatus for processing value documents, the apparatus comprising:

a plurality of processing zones, each of the processing zones including different components for processing the value documents in different working steps;

wherein each of the processing zones includes at least one cover that covers an internal space of the corresponding processing zone, and wherein each of the processing zones includes at least one interior illumination unit configured to illuminate an interior of the corresponding processing zone, wherein, for each of the processing zones, at least one region of the cover or adjacent to the cover is semitransparent in such a fashion that the internal space of the apparatus in the region of the processing zone in question is visible through the semitransparent region when the interior lighting unit is switched on, wherein the apparatus is adapted to detect events which require an intervention by an operator of the apparatus, wherein the apparatus is further adapted, upon detecting any of the events, to switch on only the interior illumination unit of the processing zone associated with the this event, such that the operator is guided directly to the location of the required intervention, and wherein the apparatus further includes an illumination clock configured to generate a clocked signal that switches on and off the illumination units at a periodicity that corresponds to a transportation rate or a singling rate of the value documents within at least one of the processing zones.

17. An apparatus for processing value documents comprising: a plurality of processing zones;

wherein each of the processing zones includes at least one cover that covers an internal space of the corresponding processing zone, wherein each of the processing zones includes at least one interior illumination unit configured to illuminate an interior of the corresponding processing zone, wherein, for each of the processing zones, at least one region of the cover or adjacent to the cover is semitransparent such that the internal space of the apparatus in the region of the processing zone is visible through the semitransparent region when the interior lighting unit is switched on, and wherein the apparatus further includes an illumination clock configured to generate a clocked signal that switches on and off at least one of said interior illumination units at a periodicity that corresponds to a transportation rate or a singling rate of the value documents within at least one of the processing zones.

* * * * *